US006286160B1

(12) United States Patent
Langegger et al.

(10) Patent No.: US 6,286,160 B1
(45) Date of Patent: Sep. 11, 2001

(54) SUPPORT FOR RECLINING OR SITTING

(75) Inventors: Josef Langegger, Saalbach; Renate Langegger-Kroell, Hinterglemm; Ingo Breitfuss, Saalbach, all of (AT)

(73) Assignee: Woodstock Company Langegger Breitfuss OEG, Saalbach (AT)

( * ) Notice: Subject to any disclaimer, the term of this patent is extended or adjusted under 35 U.S.C. 154(b) by 0 days.

(21) Appl. No.: 09/462,586

(22) PCT Filed: Jun. 4, 1998

(86) PCT No.: PCT/EP98/03345

§ 371 Date: Jan. 8, 2000

§ 102(e) Date: Jan. 8, 2000

(87) PCT Pub. No.: WO99/02075

PCT Pub. Date: Jan. 21, 1999

(30) Foreign Application Priority Data

Feb. 4, 1998 (AU) ..... 198 01 362
Mar. 18, 1998 (AU) ..... 198 11 854

(51) Int. Cl.[7] ..... A47C 23/06; A47C 27/10
(52) U.S. Cl. ..... 5/236.1; 5/239
(58) Field of Search ..... 5/236.1, 238, 239, 5/241, 244, 934

(56) References Cited

U.S. PATENT DOCUMENTS 4,477,935 * 10/1984 Griffin ..... 5/236.1 X
4,525,886 * 7/1985 Savenije ..... 5/236.1 X
5,038,429 8/1991 Elmalek et al. ..... 5/236.1
5,060,326 * 10/1991 Oswald ..... 5/236.1
5,070,560 * 12/1991 Wilkinson ..... 5/236.1 X
5,127,114 * 7/1992 Hörburger ..... 5/239
5,210,889 * 5/1993 Wessemann et al. ..... 5/236.1
5,265,290 * 11/1993 Van Raemdonck ..... 5/236.1
5,412,821 * 5/1995 Wilkinson ..... 5/236.1 X
5,524,307 * 6/1996 Griffin ..... 5/236.1 X
5,692,258 * 12/1997 Griffin ..... 5/710

FOREIGN PATENT DOCUMENTS 620 581 12/1980 (CH) .
2621803 * 6/1977 (DE) ..... 5/236.1
32 32 123 3/1984 (DE) .
34 13 156 10/1985 (DE) .
4321818 * 1/1994 (DE) ..... 5/239
0 038 155 10/1981 (EP) .
116237 * 7/1984 (EP) ..... 5/236.1
0 161 392 11/1985 (EP) .
0 378 469 7/1990 (EP) .
0 697 184 2/1996 (EP) .
8400147 * 11/1984 (NL) ..... 5/238
WO 94/01024 1/1994 (WO) .

* cited by examiner

*Primary Examiner*—Lynne H. Browne
*Assistant Examiner*—Robert G. Santos
(74) *Attorney, Agent, or Firm*—Flynn, Thiel, Boutell & Tanis, P.C.

(57) ABSTRACT

A support for reclining or sitting has two tubes extending in the longitudinal direction and filled with a liquid, transverse rods being guided on said tubes so as to be movable back and forth in the loading direction. A cushion is disposed on the transverse rods and extends over the tubes from one side of the support to the other.

18 Claims, 2 Drawing Sheets

SUPPORT FOR RECLINING OR SITTING

BACKGROUND OF THE INVENTION

A bed is known from DE 32 32 123 A 1. The tubes are disposed in troughs and the transverse rods formed as boards resting with the broad side on the tubes. The ends of the boards are guided in slots on the inside of the troughs, being disposed below the upper edges of the troughs. The area of the transverse rods above the tubes can thus not be used as a rest for a mattress or similar cushion.

EP 0 161 392 A 1 discloses a support wherein a cover is fastened to the substructure on both long sides so as to encompass the tubes, transverse rods and cushion on the transverse rods to form one unit. With this support the area above the tubes can be used to recline on, but single parts can only be replaced if the cover is removed. This makes it difficult both to replace or turn over the cushion and to replace a broken transverse rod or leaky tube.

EP-A-0 378 469 discloses a bed support. The transverse rods are supported on the tube via a shaft with a piston. The tube is for this purpose disposed in a rectangular hollow section having high side walls for guiding the piston. This not only results in a high structure. Since the person's weight on the bed is transferred to the tube via the piston, the piston with the shaft must also be of elaborate stable design. In addition, the pistons must be pushed into the hollow section from one side and then awkwardly connected with the transverse rods.

SUMMARY OF THE INVENTION

The object of the invention is to provide such a support which permits unproblematic replacement of the cushion as well as the other parts while having a maximum reclining surface and simple structure.

In the inventive support the cushion, tubes, transverse rods and other parts can be replaced without any problem. To prevent the transverse rods from shifting when moved back and forth in the loading direction, they are guided. To permit their total length to be used as a rest for the cushion, the transverse rods are disposed according to the invention so as to protrude beyond the guide means.

Further, one guides the transverse rods by fastening guide rods to the transverse rods and providing guide members on the longitudinal bars of the substructure laterally beside the tubes, said guide rods being inserted in said guide members so that the guide rods are mounted displaceably in the guide members.

The guide member can be formed by a bore in the longitudinal bar. In a further preferred embodiment the guide rod is formed by a piston fastened to the transverse rods, and the guide member by a cylinder firmly connected with the longitudinal bar, said piston being mounted displaceably in said cylinder.

The tubes are preferably made of a nonexpandable material, in particular woven hose, i.e. pressure tubing like a fire hose. The weave can be embedded in a thermoplastic resin. The tubes can have a constant diameter over their total length. However, it is also possible to provide the tubes with constrictions or a widened diameter in certain areas.

The tubes are preferably filled with a liquid, in particular water, or pellets, but only partly, preferably less than four fifths and more than one quarter, in particular less than three quarters and more than one half. The nonexpandable tubes partly filled with liquid or pellets result in uniform distribution of pressure on the body and thus an essential improvement in reclining comfort.

The transverse rods are preferably formed by wooden laths or boards. The substructure is likewise preferably made of wood.

The inventive support can be formed in particular as a slatted base for a bedstead, in particular a bedding box.

The substructure is then supported on the mounting strips normally fastened to the inner sides of the two long sides of the bedding box.

However, the inventive support can also be provided on seating furniture, whereby it can form the seat but also the back rest.

BRIEF DESCRIPTION OF THE DRAWINGS

In the following, several embodiments of a slatted base as embodiments of the inventive support will be explained in more detail with reference to the drawing, in which.

DETAILED DESCRIPTION

Figure 1:
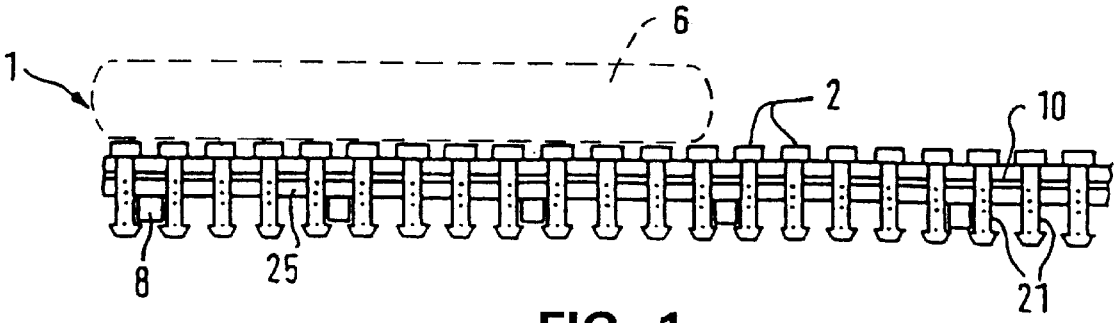
FIG. 1 shows a longitudinal section of an embodiment of the slatted base.
Figure 2:
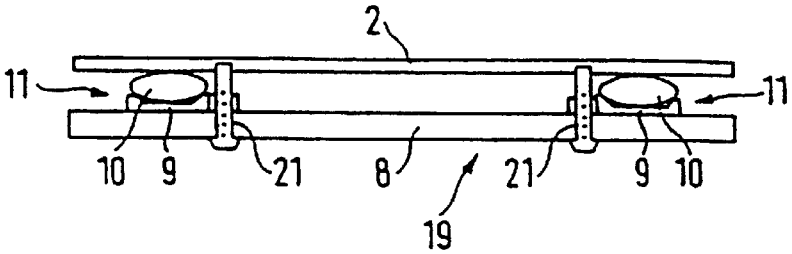
FIG. 2 shows a cross section corresponding to FIG. 1 of the slatted base.

According to FIGS. 1 and 2, slatted base 1 has transverse rods 2 formed by slats as a rest for a cushion not shown.

The transverse rods 2 are spaced apart at a distance corresponding approximately to their width. However, the distance of transverse rods 2 can also be smaller or greater, for example three or more times their width. This depends in particular on the thickness and solidity of the cushion resting on transverse rods 2.

Longitudinal beams 9, e.g. boards, are fastened to cross-beams 8 on each long side of slatted base 1. On each longitudinal beam 9 on each long side of slatted base 1 there are tubes 10 on which transverse rods 2 rest. Tubes 10 are formed, for example, by pressure tubing two thirds filled with water.

The cushion 6, shown in phantom, can extend over the total length of transverse rods 2, i.e. also in the area of tubes 10, so that the total width of slatted base 1 is available as a resting surface.

Figure 3:
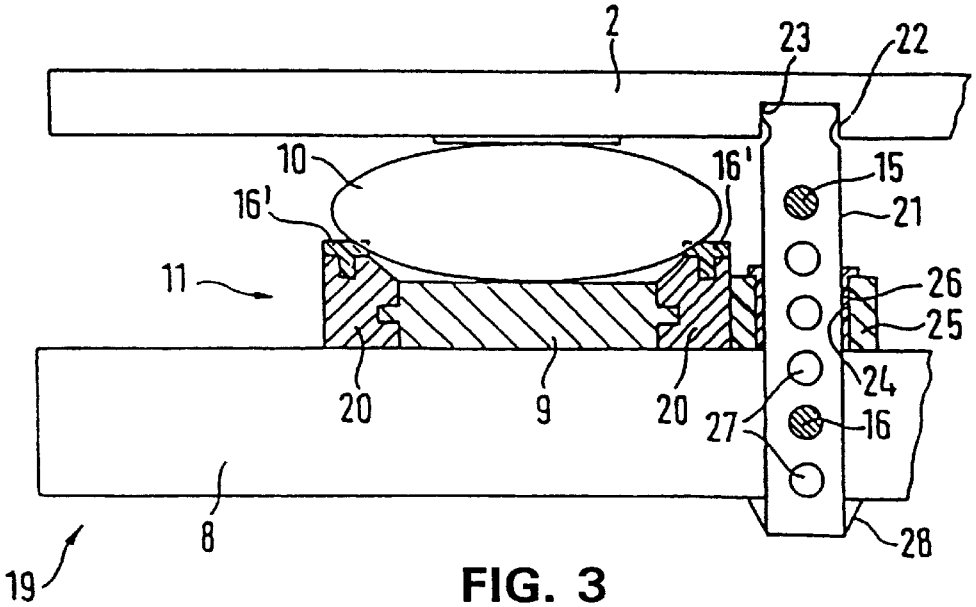
FIG. 3 shows a partial view of FIG. 2 in an enlarged view.

As evident in particular from FIG. 3, each longitudinal beam 9 consists of a board and two narrow side walls 20, formed e.g. by boards. These boards are provided on their upper edges with strips 16 made, for example, of plastic. Tube 10 extends upwardly laterally above the upper edges of side walls 20. Thus, no frictional noise can occur through tube 10.

Side walls 20 are beveled inwardly and downwardly. They are also formed as low as possible in order not to hinder transverse rods 2 upon compression of tube 10.

In order to limit the up-and-down motion, or in general reciprocal motion, of transverse rods 2, two guide rods 21 are disposed a distance apart on each transverse rod 2 so that two rows of guide rods 21 extend along slatted base 1.

Guide rods 21 are set at one end in blind bore 22 on the lower side of particular transverse rod 2. For fastening guide rod 21 in blind bore 22, one provides barblike projections 23 at the end of guide rod 21 facing transverse rod 2. These projections 23 are formed so that the end of guide rod 21 can be inserted into blind bore 22 but not pulled out again.

For guiding each row of guide rods 21, one provides bores 24 in longitudinal bars 25 which extend at a distance apart along slatted base 1 and are fastened to crossbeams 8 laterally beside one and the other tube rest 11. Longitudinal bars 25 are thus firmly connected with substructure 19. Guide rods 21 are guided in bores 24 in the loading direction, i.e. so as to be movable up and down in slatted base 1 shown.

Longitudinal bars 25 can consist of wooden laths. In order to reduce sliding friction and prevent sliding noise, one can provide sliding bushes 26, made e.g. of plastic, in bores 24. Longitudinal bars 25 can also be made completely of plastic.

To limit the up-and-down motion of guide rods 21 a stop is provided at least above longitudinal bar 25 or sliding bushes 26.

For this purpose one provides a plurality of bores 27 along each guide rod 21 for insertion of cross pins 15, 16. Cross pin 15 inserted into bore 27 above longitudinal bar 25 limits the downward motion of transverse rod 2, while cross pin 16 inserted into bore 27 below longitudinal bar 25 limits the upward motion of transverse rod 2. To prevent guide rod 21 from being pulled out of bores 24, guide rods 21 can additionally have at the lower end barb-shaped stop 28 which can be inserted through bore 24 from above but not pulled out of bore 24 again.

Guide rods 21, including barblike projections 23 and 28, can be made of plastic.

Through insertion of cross pins 15, 16 into bores 27 in guide rods 21 at a suitable height one can adjust the maximum and minimum height of each transverse rod 2 individually upon use of the bed.

In order to improve comfort, tubes 10 can also have different diameters along slatted base 1. By a greater diameter in certain areas one can achieve softer cushioning there.

Figure 4:
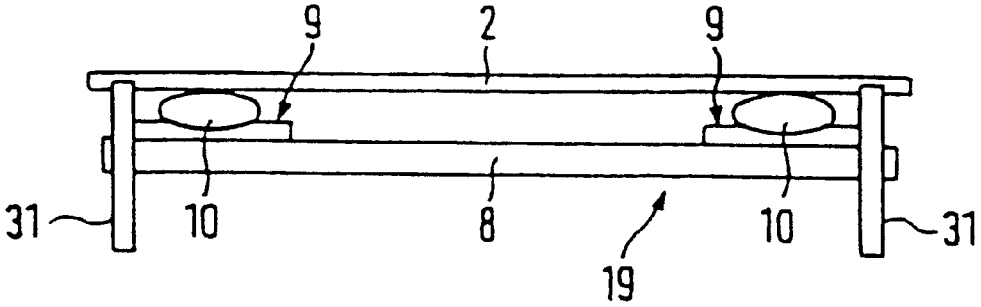
FIG. 4 shows a cross section corresponding to FIG. 2 through a further embodiment of the slatted base.
Figure 5:
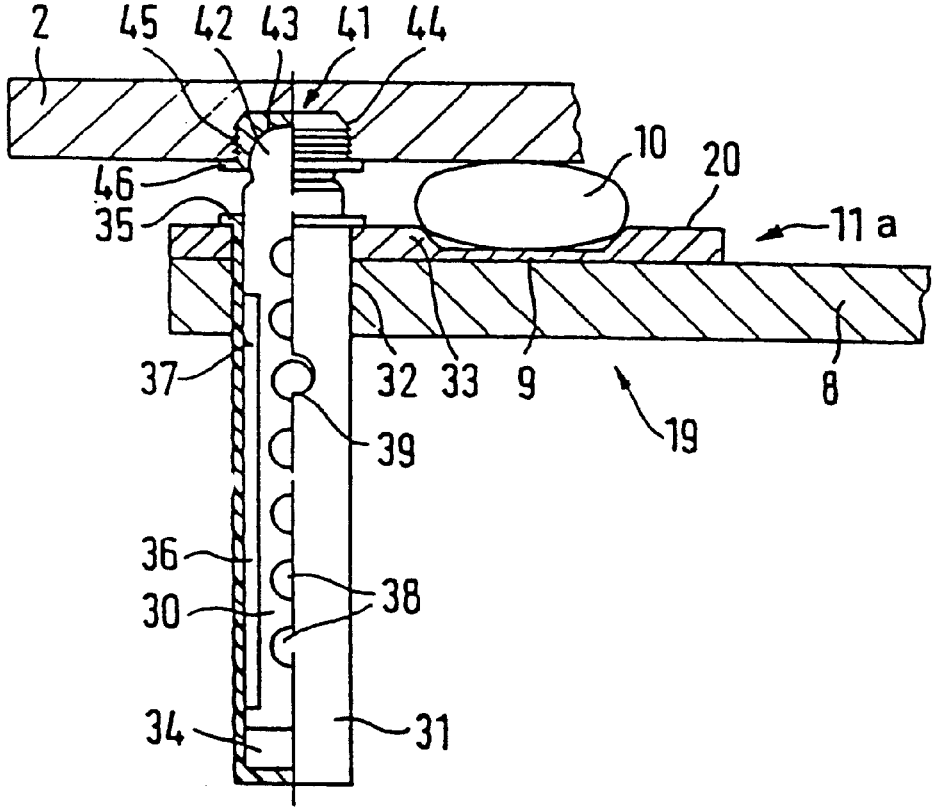
FIG. 5 shows a partial view of FIG. 4 in an enlarged view.

To limit the up-and-down motion, or in general reciprocal motion, of transverse rods 2, transverse rods 2 are connected in the embodiment according to FIGS. 4 and 5 with substructure 19, i.e. cross- and longitudinal beams 8, 9, by pistons 30 fastened to transverse rods 2 and mounted displaceably in cylinders 31 firmly connected with substructure 19.

On each transverse rod 2, two pistons 30 are disposed at a distance apart so that two rows of pistons 30 or cylinders 31 extend along the slatted base.

Cylinders 31 are set in bores 32 in longitudinal bars 33 disposed on crossbeams 8. Each longitudinal bar 33, together with side wall 20 and longitudinal beam 9, forms a rest 11*a* for tube 10.

Piston 30 closes cylinder space 34 in which air is compressed when piston 30 is pushed into cylinder 31, and a vacuum is produced when piston 30 is drawn out of cylinder 31.

This damps the motion of piston 30 and thus of transverse rods 2, which results in reduced noise since it prevents transverse rod 2 from hitting parts when subjected to a sudden stronger load, for example when a person gets on the bed. In addition the damped motion suppresses sliding and frictional noise.

Piston 30 and cylinder 31 are preferably made of plastic. Piston 30 can also be of hollow design. At its end facing transverse rod 2 cylinder 31 has collar-shaped radial projection 35 which supports it on longitudinal bar 33.

To limit the upward motion of transverse rod 2, piston 30 is provided with longitudinal groove 36 which is engaged by projection 37 on cylinder 31. Along piston 30 there are a plurality of cross bores 38 for insertion of a cross pin (not shown). This permits adjustment of the maximum depth of transverse rod 2. For this purpose piston 30 is pulled out of cylinder 31 until cross bore 38 in which the cross pin (not shown) is inserted protrudes beyond collar-shaped projection 35, said pin then determining as a stop the deepest position of transverse rod 2.

Cylinder 31 has opening 39 in its circumferential wall. When the cross pin (now shown) is inserted in opening 39 and through one of cross bores 38 flush therewith, the motion of transverse rod 2 is completely blocked.

Limiting or blocking the motion of the transverse rod can be desirable for example in the head area of a bed.

Piston 30 is fastened to transverse rod 2 via ball joint 41. This permits transverse rod 2 to be adapted better to the body. It also results in better distribution of forces, for example when one climbs onto the bed. In addition, no clamping forces occur in cylinder 31 which could cause frictional noise for example.

Ball joint 41 consists of spherical part 42 on piston 30 and ball socket 43 inserted into blind bore 44 in transverse rod 2. Ball socket 43 is for this purpose provided on the outside with barb-shaped projections 45 so formed that ball socket 43 inserted into blind bore 44 cannot be pulled out again. Further, ball socket 43 has radial collar-shaped projection 46 disposed around blind bore 44 on the lower side of slat 2. Ball socket 43 is likewise preferably made of plastic.

What is claimed is:

1. A support for reclining or sitting, said support including:

at least two parallel, spaced apart longitudinal beams;

at least two parallel, spaced apart tubes, each said tube being at least partially filled with a medium and being seated on a separate one of said longitudinal beams;

a plurality of transverse rods that extend between said longitudinal beams and over said tubes;

a substructure for limiting movement of said transverse rods, rods, said substructure including:

a plurality of longitudinal bars, each said longitudinal bar being located adjacent a side of one of said tubes so that said longitudinal bars are located below said transverse rods, each said longitudinal bar being formed with a plurality of holes, each hole being located under a separate one of said transverse rods;

a plurality of guide rods, each said guide rod being slidably fitted in a separate one of the holes of said longitudinal bars and each said guide rod having a head end that is attached to said transverse rod located over the hole in which said guide rod is fitted and being shaped to have a plurality of longitudinally spaced apart bores that extend laterally through said guide rod; and a pair of opposed stops attached to each said guide rod, said stops being located on opposed sides said of said longitudinal bar in which said guide rod is fitted, each said stop being positioned to abut said longitudinal bar so as to limit movement of said guide rod, wherein at least one said stop is a pin that is removably fitted in one of the bores that is formed in said guide rod; and a cushion disposed over exposed surfaces of said transverse rods.

2. The support of claim 1, wherein the medium that at least partially fills said tubes is a liquid.

3. The support of claim 1, wherein:

said transverse rods have opposed ends; and two said tubes are provided, each said tube being located under a separate one of the ends of said transverse rods.

4. The support of claim 1, wherein both said stops associated with said guide rods are pins that are removably fitted in the bores formed in said guide rods.

5. A support for reclining or sitting, said support including:

at least two parallel, spaced apart longitudinal beams;

at least two parallel, spaced apart tubes, each said tube being at least partially filled with a medium and being seated on a separate one of said longitudinal beams;

a plurality of transverse rods that extend between said longitudinal beams and over said tubes;

a substructure for limiting movement of the transverse rods, said substructure including:

a plurality of longitudinal bars, each said longitudinal bar being located adjacent a side of one of said tubes so that said longitudinal bars are located below said transverse rods; and a plurality of piston assemblies, each said piston assembly including: a cylinder that is fixedly connected to said longitudinal bar, each said cylinder being located under one of said transverse rods; and a piston rod that is slidingly and sealing fitted in said cylinder, each said piston rod having a head end that is fitted to said transverse rod located over said cylinder; and a cushion disposed over exposed surfaces of said transverse rods.

6. The support of claim 5, wherein:

said longitudinal bars are formed with a plurality of holes, each said hole being located under a separate one of said transverse rods; and said cylinders are seated in the holes formed in said longitudinal bars.

7. The support of claim 6, wherein each said cylinder is formed with a projection and said projection holds said cylinder to said longitudinal bar to which said cylinder is connected.

8. The support of claim 5, wherein:

said cylinder is formed with a projection that is directed towards said piston rod; and said piston rod has an outer surface and is formed to define an elongated groove that extends upwardly from a position above a bottom end of said piston rod and said piston rod is positioned in said cylinder so that said projection is seated in the groove.

9. The support of claim 5, wherein said piston rod is formed with a plurality of longitudinally spaced apart bores so that a cross pin can be selectively fitted through said piston rod to lock said piston rod to limit movement of said piston rod.

10. The support of claim 9, wherein said cylinder is provided with a bore so that a cross pin can be selectively fitted through said cylinder and said piston rod.

11. The support of claim 5, wherein said piston rod head ends are moveably fitted into said transverse rods.

12. The support of claim 11, wherein said piston rod head ends are fitted to said transverse rods by ball joints.

13. The support of claim 5, wherein the medium that partially fills said tubes is a liquid.

14. The support of claim 5, wherein:

said transverse rods have opposed ends; and two said tubes are provided, each said tube being located under a separate one of the ends of said transverse rods.

15. The support of claim 5, wherein each said longitudinal beam is formed to have a portion that defines an adjacent one of said longitudinal bars.

16. The support of claim 15, wherein:

said transverse rods have opposed ends; and two said tubes are provided, each said tube being located under a separate one of the ends of said transverse rods.

17. The support of claim 16, wherein two rows of said piston assemblies are provided, each said row of pistons being located adjacent an outwardly directed surface of an adjacent said tube.

18. The support of claim 16, wherein each said longitudinal beam is formed to have a portion that defines an adjacent one of said longitudinal bars.

* * * * *

UNITED STATES PATENT AND TRADEMARK OFFICE

CERTIFICATE OF CORRECTION

PATENT NO. : 6,286,160 B1
DATED : September 11, 2001
INVENTOR(S) : Josef Langegger et al.

It is certified that error appears in the above-identified patent and that said Letters Patent is hereby corrected as shown below:

Title page,
Item [86], change "Jan 8, 2000" to -- Jan. 7, 2000 --

Signed and Sealed this

Ninth Day of July, 2002

*Attest:*

*Attesting Officer*

JAMES E. ROGAN
*Director of the United States Patent and Trademark Office*